US005953025A

United States Patent [19]

Sakurai

[11] Patent Number: 5,953,025

[45] Date of Patent: Sep. 14, 1999

[54] INK JET PRINTER HAVING A PRINT HEAD WITH A WIPER WHICH MOVES IN THE SAME DIRECTION AS THE PRINT HEAD AT A LOWER VELOCITY FOR WIPING THE PRINT HEAD

[75] Inventor: Yoshihiko Sakurai, Tokyo, Japan

[73] Assignee: Oki Data Corporation, Tokyo, Japan

[21] Appl. No.: 08/881,403

[22] Filed: Jun. 24, 1997

[30] Foreign Application Priority Data

Jun. 25, 1996 [JP] Japan ..... 8-164461

[51] Int. Cl.[6] ..... B41J 2/165

[52] U.S. Cl. ..... 347/33; 347/32

[58] Field of Search ..... 347/33, 32, 37; 400/701

[56] References Cited

FOREIGN PATENT DOCUMENTS 62-77943 4/1987 Japan ..... 347/33

3-258553 11/1991 Japan ..... 347/33

6-143597 5/1994 Japan ..... 347/31

*Primary Examiner*—N. Le

*Assistant Examiner*—Thien Tran

*Attorney, Agent, or Firm*—Panitch Schwarze Jacobs & Nadel, P.C.

[57] ABSTRACT

An ink jet printer has a print head adapted to move in a printing area and in a wiping area outside of the printing area. The print head ejects ink drops through orifices in accordance with print data while it is moving in the print area. The wiper is disposed in the wiping area. The nozzle plate having orifices formed therethrough is wiped off when the print head moves in the wiping area. A wiper transporting mechanism includes a supporting mechanism for supporting and moving the wiper parallel with the print head when the print head moves in the wiping area, the wiper being transported at a velocity lower than the print head so that the wiper gently wipes the nozzle plate preventing the ink adhering to the wiper from splashing.

8 Claims, 15 Drawing Sheets

INK JET PRINTER HAVING A PRINT HEAD WITH A WIPER WHICH MOVES IN THE SAME DIRECTION AS THE PRINT HEAD AT A LOWER VELOCITY FOR WIPING THE PRINT HEAD

BACKGROUND OF THE INVENTION

1. Field of the Invention

The present invention relates to an ink jet printer.

2. Description of Related Art

Conventional ink jet printers are of the construction in which ink drops are ejected to the print paper through orifices formed in a nozzle plate. If dust is attracted on the nozzle plate, the dust jams the orifices resulting in missing dots in the print. This deteriorates print quality and may lead to a printer failure.

Therefore, a cleaning unit is usually provided at the home area of the ink jet head, so that the wiper of the cleaning unit wipes the dust from the nozzle plate when the ink jet head returns to the home area at predetermined time intervals during printing operation. FIG. 18 illustrates a general construction of a conventional ink jet printer.

Referring to FIG. 18, a print head 12 is held directly over print paper 11 which is transported it its path. The print head 12 is carried on a carriage 13 which is moved slidably on a guide shaft 14 extending transversely of the path and in parallel to the surface of the print paper 11. An endless belt 15 is disposed about the pulleys 15*a* and 15*b* which are connected to the shaft, not shown, of a spacing motor 16, and is securely connected to the carriage 13. When the spacing motor 16 drives the pulley 15*a* in rotation in directions shown by arrow, the pulleys 15*a* and 15*b* cause the belt 15 to run so that the carriage 13 carrying the print head 12 thereon is moved in directions shown by arrows A1 and A2.

The print head 12 is adapted to move both in a print area and in a home area. When the print head 12 is in the print area, the print head 12 performs printing operation by ejecting ink drops through the orifices to the print paper 11 while moving in the directions shown by arrows A1 and A2.

The print head 12 enters the home area at predetermined timings during printing operation, so that the dust trapped on the nozzle plate 12*a* is wiped off. The print head 12 also enters the home area after printing operation so as to cap the nozzle plate 12*a* to protect from the environment. For cleaning and capping purposes, a cleaning unit 21 is disposed at a location in the home area where the cleaning unit 21 opposes the guide shaft 14. The cleaning unit includes a wiper 17, holder 18, cap 19, and holder 20. The wiper 17 is supported by the holder 18 and wipes the dust off the nozzle plate 12*a*. The cap 19 is held by the holder 20 and closes the nozzle plate 12*a* to prevent the ink from drying when not printing.

The wiper 17 and cap 19 are formed or a resilient material such as rubber. The wiper 17 is moved in directions shown by arrows B1 and B2 to take tip an operation position and standby position, respectively. The cap 19 is moved in directions shown by arrows C1 and C2 to take up an operation position and standby position, respectively.

The wiping operation of the aforementioned construction will be described. FIGS. 19–22 illustrate a relevant part of the conventional ink jet printer. For clarity of explanation, the cap 19 and holder 20 have been omitted throughout FIGS. 19–22.

As shown in FIG. 19, the print head 12 is moved in the direction shown by arrow A1 and subsequently the wiper 17 is moved in the direction shown by arrow B1 to the operation position. Then, as shown in FIG. 20, the wiper 17 is stopped at a predetermined position relative to the shaft 14 while the print head 12 moves still further in the direction shown by arrow A1 to a position shown in FIG. 21 so that the dust on the nozzle plate 12*a* is wiped off. This completes a first stage of wiping operation.

Then, the print head 12 is moved in the direction shown by arrow A2 as shown in FIG. 22, so that the nozzle plate 12*a* is again wiped by the wiper 17. Then, the print head 12 moves still further in the direction shown by arrow A1, completing a second stage of wiping operation.

In this manner, the wiping operation is performed. Upon completion of the second stage of wiping operation, the wiper 17 is moved in the direction shown by arrow B2 (FIG. 18) so that the cleaning unit 21 enters its standby condition as shown in FIG. 19.

However, the aforementioned conventional ink jet printer suffers from the following disadvantages. The print head 12 moving in the directions shown by arrows A1 and A2 causes the wiper 17 to resiliently flex so that the wiper 17 causes tile ink to splash as the wiper 17 moves out of engagement with the print head 12 and resiliently regains its original shape. The splash of ink causes soiling of the interior of the ink jet printer and repetitive wiping operation causes the wiper 17 to wear.

One way of preventing the ink from splashing is to reduce the velocity of the print head 12 so that the wiper 17 slowly flexes when it moves into and out of engagement with the print head 12. However, reducing the velocity of the print head 12 decreases the amount of data printed by the printer per unit time, i.e., the throughput of the printer.

SUMMARY OF THE INVENTION

An object of the invention is to solve the aforementioned drawbacks of the conventional ink jet printer and to provide an ink jet printer in which the operation of the wiper does not cause soiling of the interior of the printer, the wiper is not subject to wear, and the throughput of printed data is maintained.

An ink jet printer has a print head adapted to move in a printing area and in a wiping area outside of the printing area. The print head ejects ink drops through orifices in accordance with print data while it is moving in the print area. A wiper is disposed in the wiping area. The nozzle plate having orifices formed therethrough is wiped off by the wiper when the print head moves in the wiping area. A wiper transporting mechanism includes a supporting mechanism that supports and moves the wiper so that the wiper moves parallel with the print head when the print head moves in the wiping area, the wiper being transported at a velocity lower than the print head so that the wiper gently wipes the nozzle plate preventing the ink adhering to the wiper from splashing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail with reference to the accompanying drawings.

First embodiment

Figure 1:
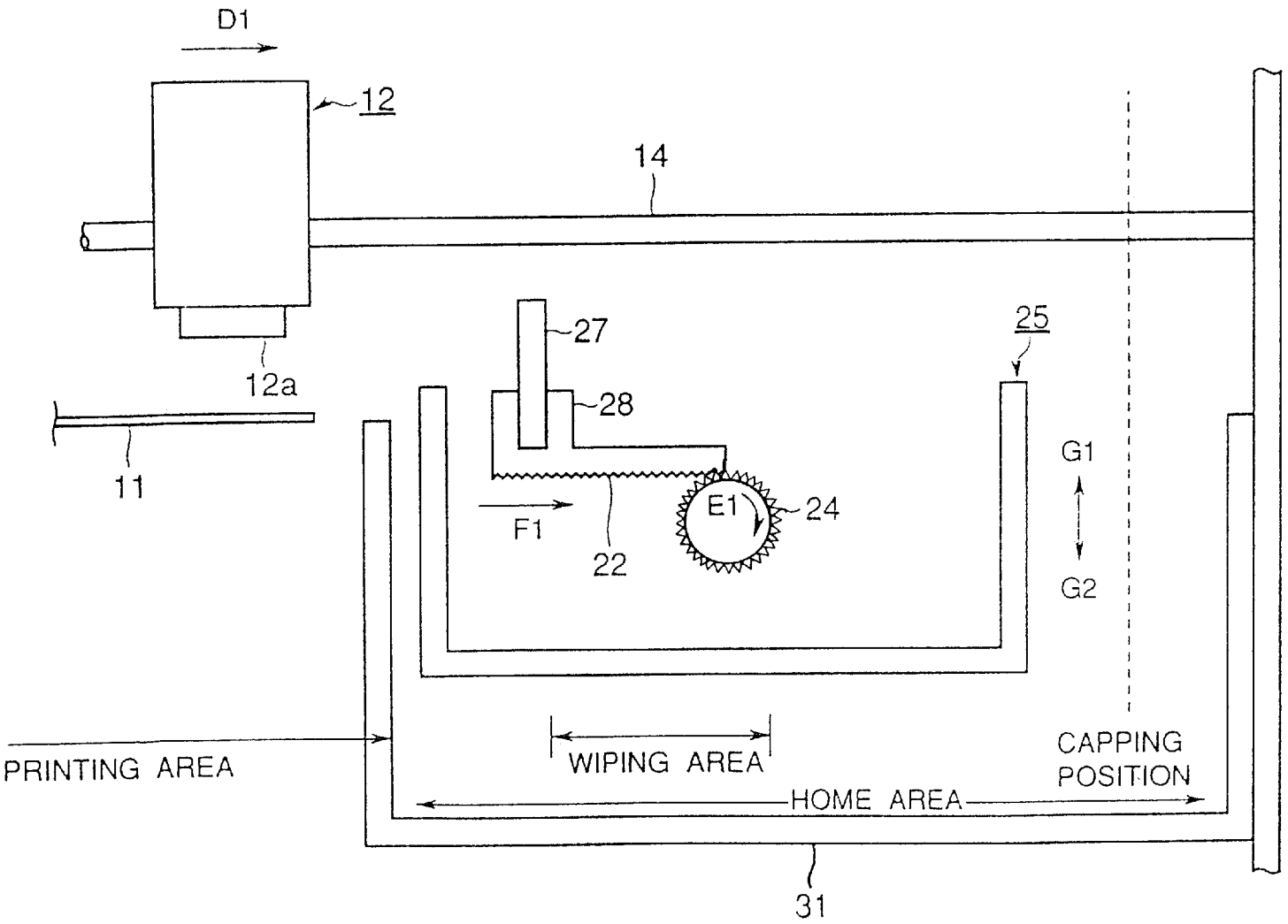
FIG. 1 illustrates a print head of a first embodiment of the invention moving from a print area toward a wiping area.
Figure 2:
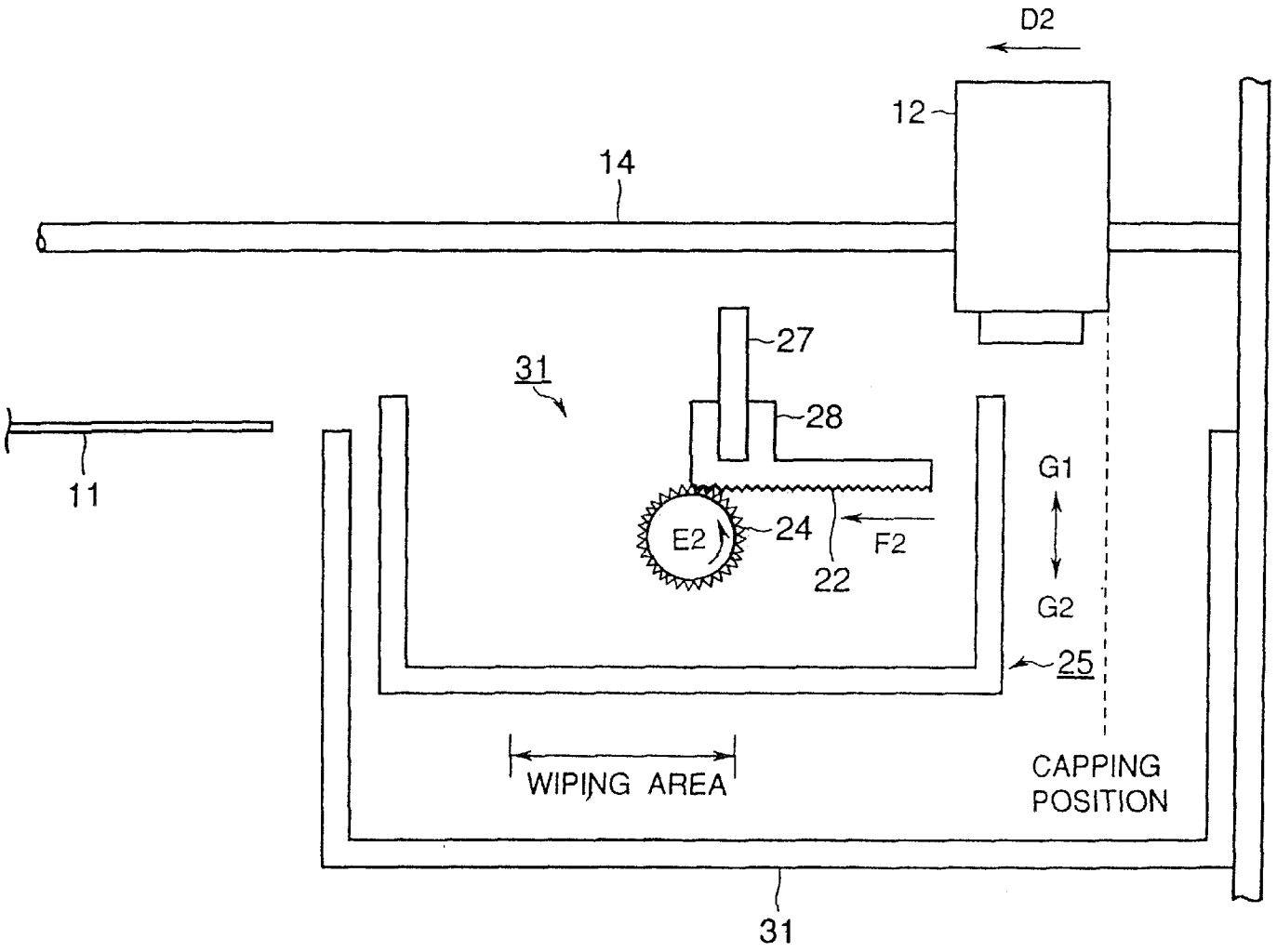
FIG. 2 illustrates the print head of FIG. 1 moving from a capping position toward the print area.

FIG. 1 illustrates a print head 12 moving from a print area to a wiping area and FIG. 2 illustrates the print head 12 moving back from a capping position to the wiping area.

Figure 3:
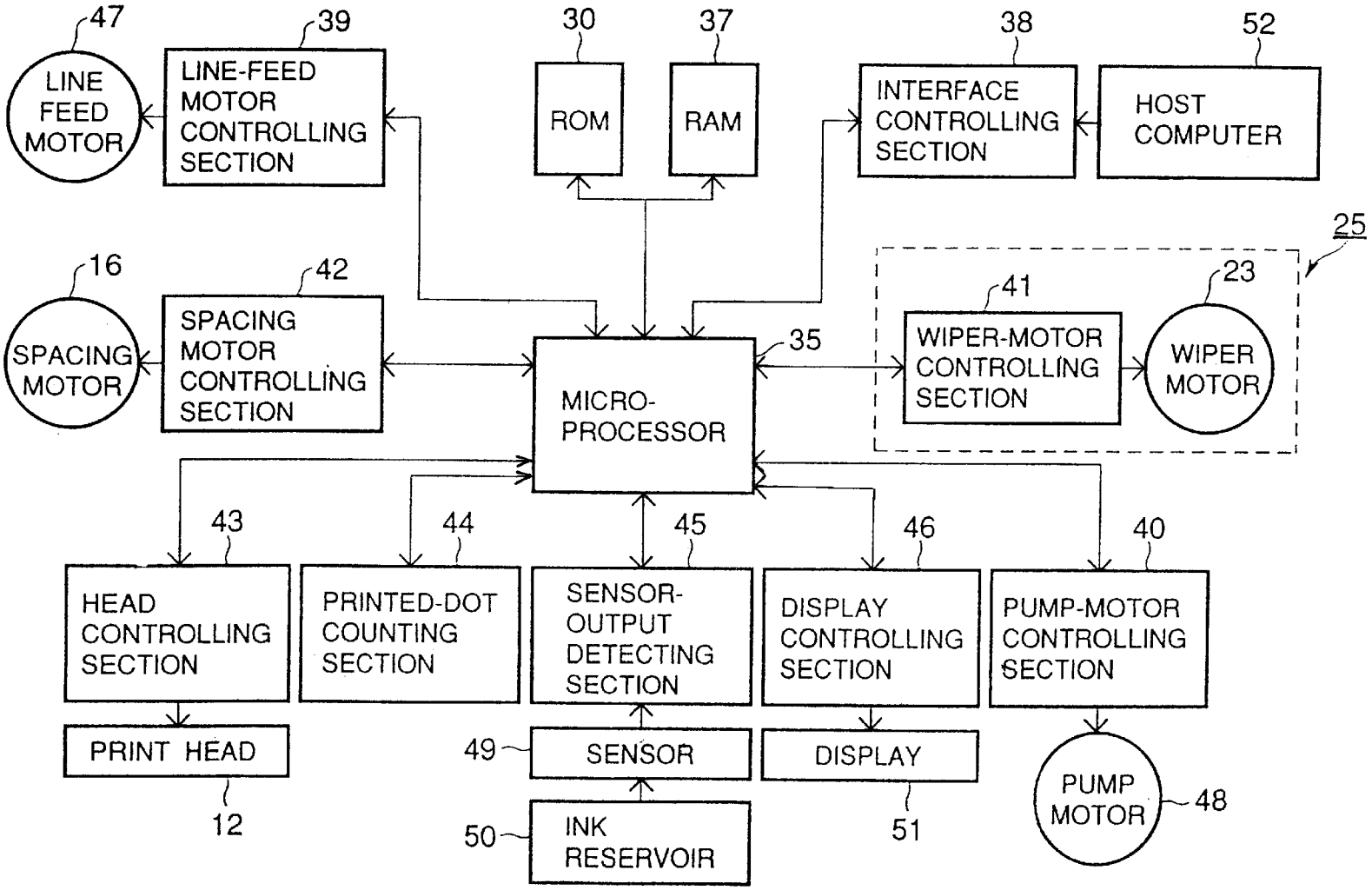
FIG. 3 is a block diagram showing the controller of an ink jet printer.

Referring to FIG. 1, the print head 12 is carried on a carriage, not shown, and held directly over print paper 11 which is transported in a direction perpendicular to the page of FIG. 1. The carriage is slidably mounted on a guide shaft 14 and securely fixed to a belt, not shown, mounted on two pulleys, not shown, which are driven in rotation by a spacing motor 16 (FIG. 3). When the spacing motor 16 runs, the belt causes the carriage to move along the guide shaft 14 in directions shown by arrows D1 and D2, transversely of the paper path and in parallel with the surface of the print paper 11.

The print head 12 is adapted to move back and forth both in the print area and in the wiping area outside of the print area during printing operation, and to stop at the capping position after the printing operation. In the print area, the print head 12 moves in the directions shown by arrows D1 and D2 while performing the printing operation by ejecting ink drops through the orifices formed in a nozzle plate 12*a*. The wiping area and capping position define a home area where the ink jet head returns for wiping operation or for capping operation after printing operation completes.

During wiping operation, the dust deposited on the nozzle plate 12*a* is wiped off. Upon completion of printing operation, the print head 12 is moved to the capping position where the nozzle plate 12*a* is capped for protecting the orifices from the environment and preventing the ink from drying up.

For wiping and capping purposes, a cleaning unit 31 is provided in the home area. The cleaning unit 31 has a wiping assembly 25 in the wiping area and a capping mechanism at the capping position. The capping mechanism includes a cap and a holder, not shown, formed of a resilient material such as rubber.

The wiping assembly 25 will be described in detail as follows:

The wiping assembly 25 includes a wiper 27 formed of a resilient material such as rubber and a holder 28 that serves as a supporting mechanism for supporting the wiper 27 therein. The holder 28 is formed with a rack 22 therein which meshes with the motor gear 24 directly connected to a wiper motor 23 (FIG. 2).

When the wiper motor 23 runs to cause the motor gear 24 to rotate in directions shown by arrows E1 and E2, the holder 28 and wiper 27 are moved in directions shown by arrows F1 and F2. The print head 12 and wiper 27 move in parallel with each other since the rack 22 extends parallel to the guide shaft 14.

The wiping assembly 25 is moved by an elevator mechanism, not shown, in a direction shown by arrow G1 to the operation position or in a direction shown by arrow G2 to the standby position.

Next, the wiping operation of the aforementioned construction will be described.

FIG. 3 is a block diagram showing the controller of an ink jet printer. FIGS. 4–9 illustrate the wiping operation of the invention.

Figure 4:
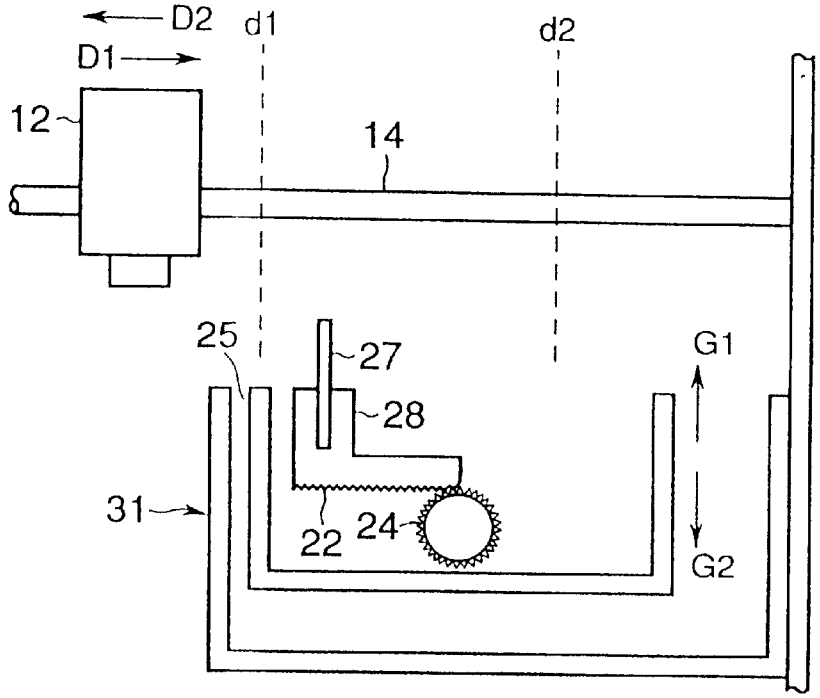
FIGS. 4–6 illustrate a first stage of the wiping operation of the invention of the first embodiment.

Referring to FIG. 3, a microprocessor 35 controls the overall operation of the ink jet printer. Upon receiving a wiping instruction from a host computer 52 via an interface control section 38, the microprocessor 35 causes the wiping assembly 25 to move in the direction shown by arrow G1 and stop at the operation position as shown in FIG. 4 and then causes the print head 12 to move in the direction shown by arrow D1 toward the home area.

If the spacing motor 16 is a pulse motor, the spacing motor 16 is controlled by the pulses generated in the spacing motor controlling section 42. A position detector, in the microprocessor 35 counts the number of pulses generated by the spacing motor controlling section 42 and the position of the print head 12 with respect to the home area is determined from the number of counted pulses.

If the spacing motor 16 is a DC motor, the spacing motor 16 is provided with a position detector such as an encoder, not shown, which detects the position of the print head 12 with respect to the home area.

In this manner, the microprocessor 35 detects the position of the print head 12 with respect to the home area at all times using the position detector during the time when the print head 12 is moved in the directions shown by arrows D1 and D2. The wiper motor 23 and position detector form wiper moving means.

Figure 5:
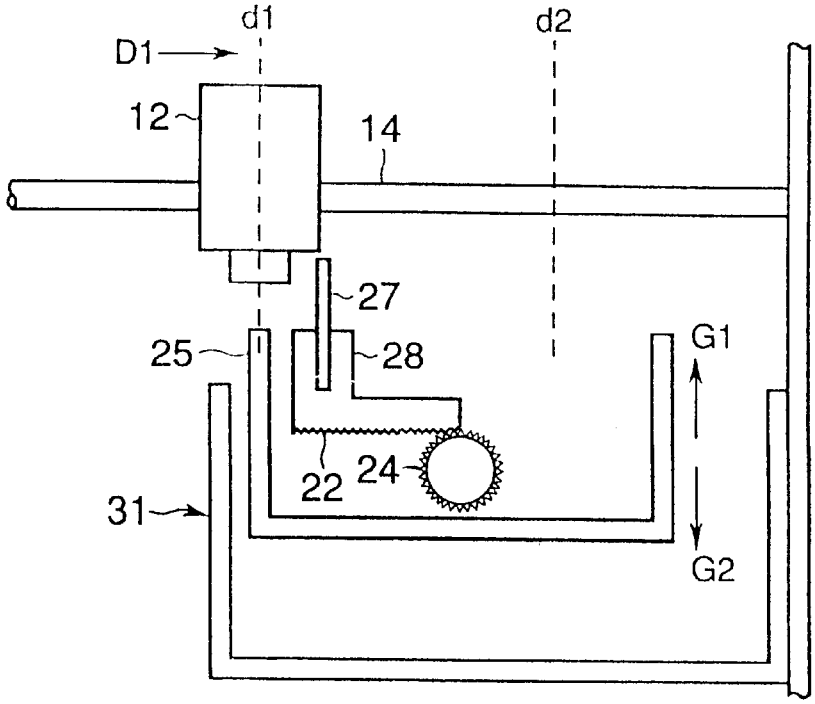
Figure 6:
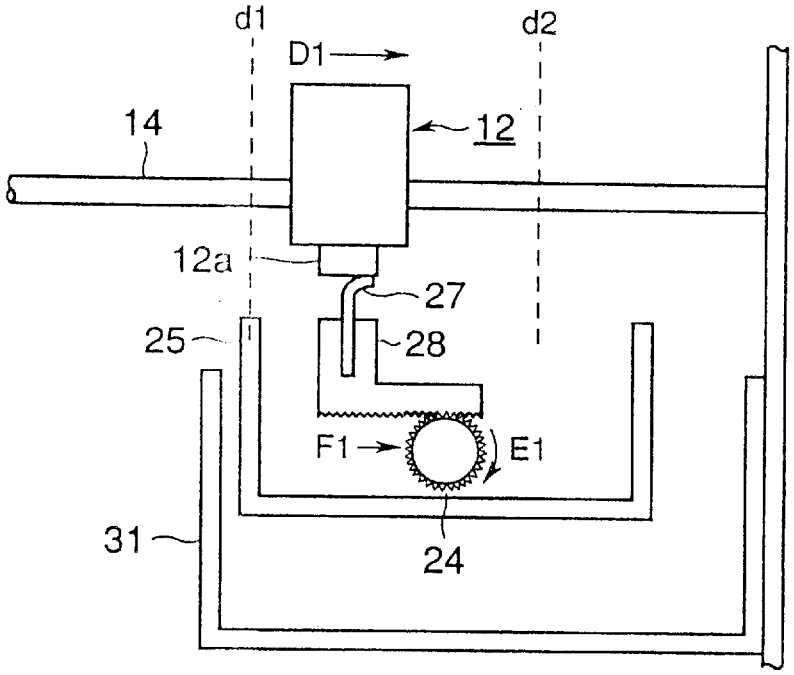
Figure 7:
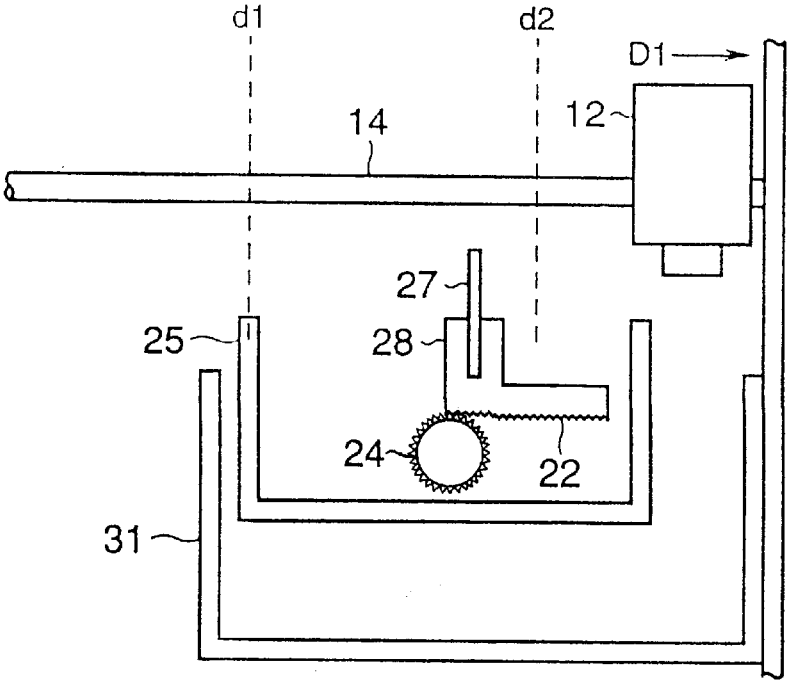
FIGS. 7–9 illustrate a second stage of the wiping operation of the invention of the first embodiment.

When the print head 12 reaches a first position d1 as shown in FIG. 5, the microprocessor 35 outputs an instruction to the wiper motor controlling section 41. In response to the instruction, the wiper motor controlling section 41 causes the wiper motor 23 in the wiping assembly 25 to run, the wiper motor 23 causing the motor gear 24 to rotate in the direction shown by arrow E1. As a result, the holder 28 and wiper 27 are moved in the direction shown by arrow F1.

Since the wiper 27 moves in parallel with the print head 12 at a lower velocity than the print head 12, the print head 12 will catch up the wiper 27 and then get ahead of it. Thus, the wiper 27 rubs the surface of the nozzle plate 12*a*, wiping the dust from the nozzle plate 12*a*.

The microprocessor 35 causes the wiper motor 23 to stop when the motor gear 24 has rotated a predetermined number of rotations after the wiper motor 23 started to rotate. Thus, the holder 28 and wiper 27 are stopped at a position shown in FIG. 7 after having moved a predetermined distance, and subsequently the print head 12 is also stopped. The predetermined number of rotations of the motor gear 24 is selected in accordance with the desired difference in velocity between the print head 12 and wiper 27.

Figure 8:
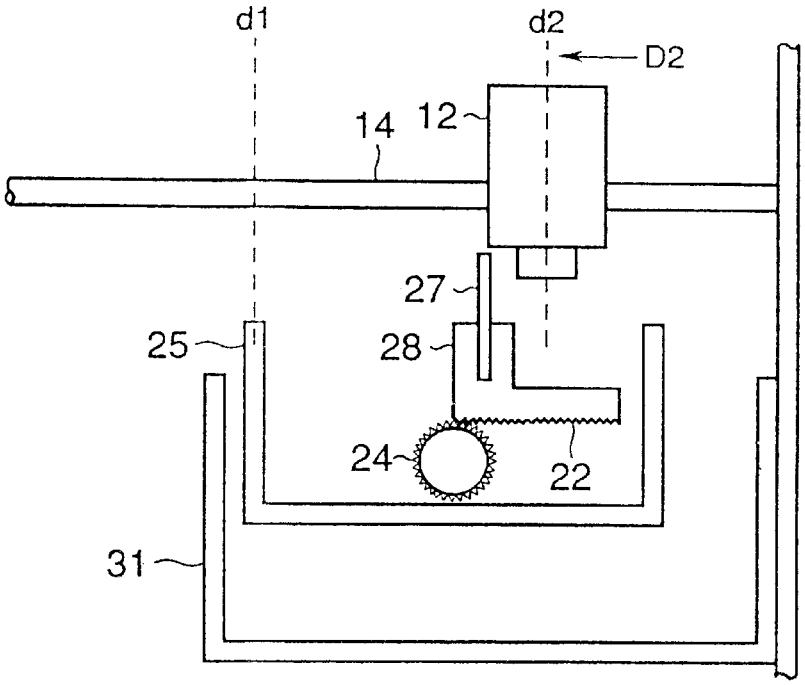
Figure 9:
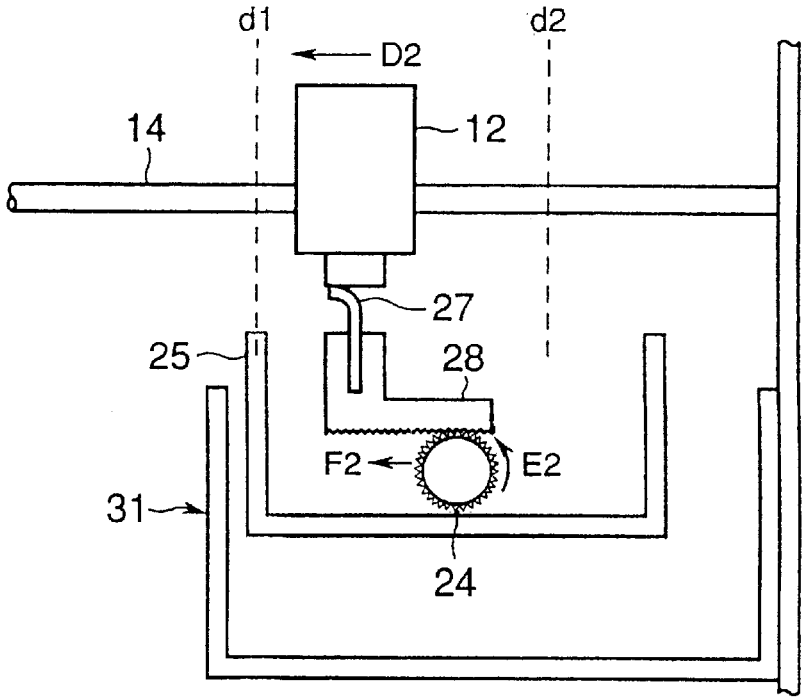

When the print head 12 arrives at a second position d2 shown in FIG. 8, the microprocessor 35 outputs an instruction to the wiper motor controlling section 41. In response to the instruction, the wiper motor controlling section 41 causes the wiper motor 23 in the wiping assembly 25 to run so that the motor gear 24 rotates in the direction shown by arrow E2 as shown in FIG. 9. As a result, the holder 28 and wiper 27 are moved in the direction shown by arrow F2.

Then, the microprocessor 35 causes the wiper motor 23 to stop when the motor gear 24 has rotated a predetermined number of rotations. The holder 28 and wiper 27 also stop after having moved a predetermined distance.

Thereafter, when the print head 12 reaches the first position d1, the microprocessor 35 causes the wiping assembly 25 to move in the direction shown by arrow G2, and then causes the print head 12 to move further in the direction shown by arrow D2 into the printing area for printing operation.

Although the wiping operation is initiated in response to the wiping instruction from the host computer 52, the wiping operation may also be performed in response to a print terminating instruction from the host computer 52.

Figure 10:
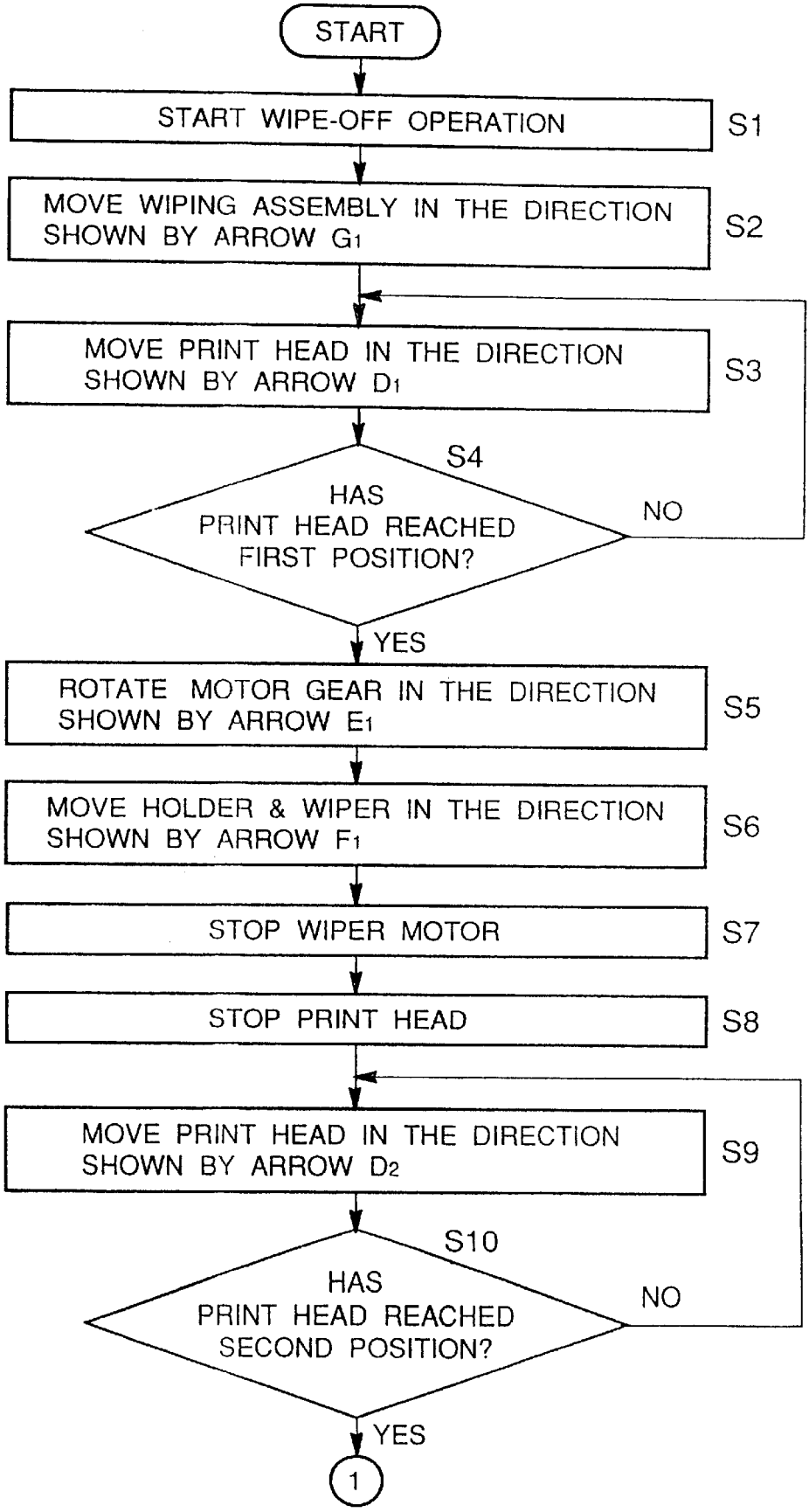
FIGS. 10 and 11 shows a flowchart illustrating wiping operation of the first embodiment.
Figure 11:
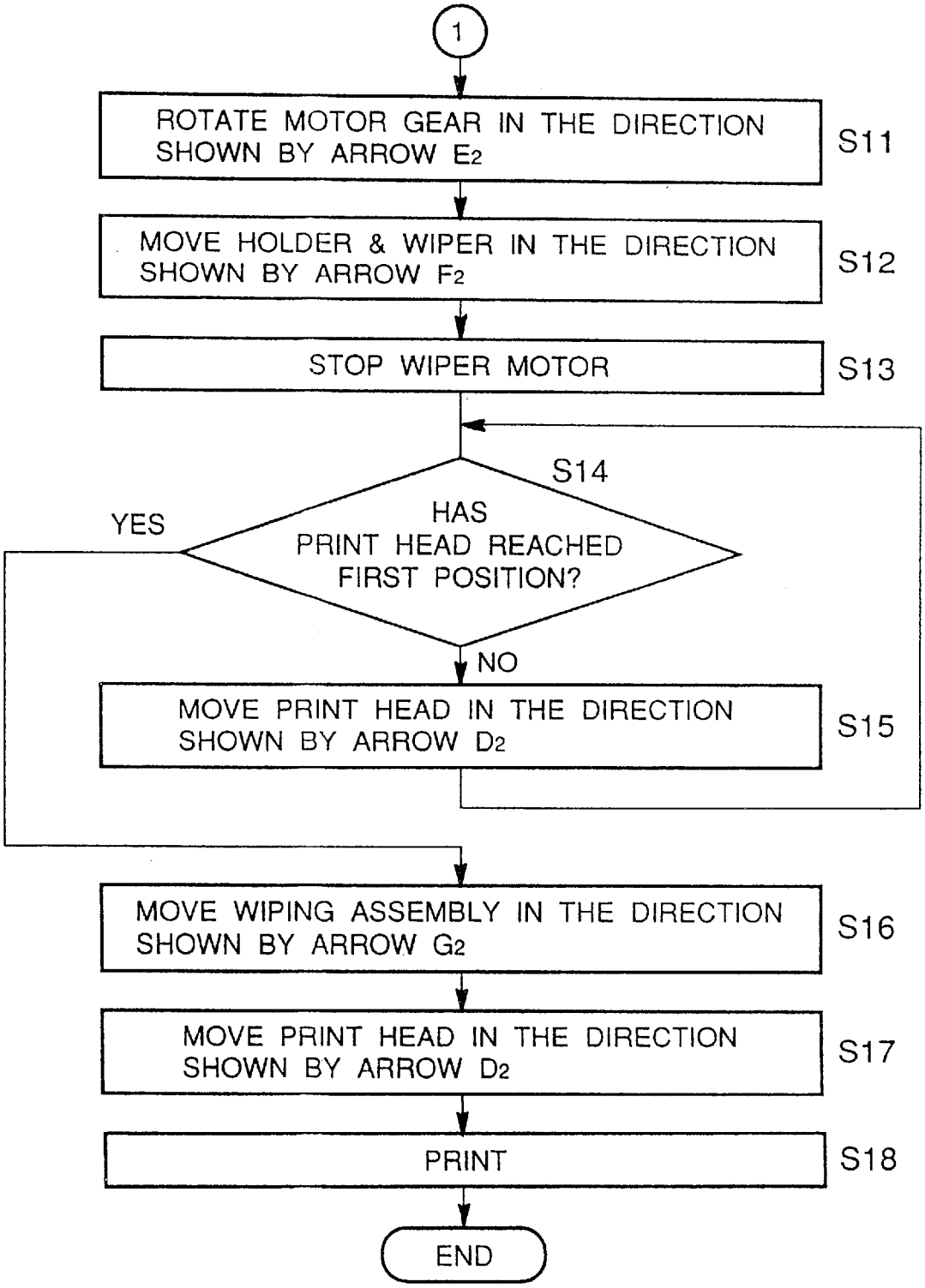

FIGS. 10 and 11 are flowcharts illustrating the wiping operation. The wiping operation will be summarized with reference to FIGS. 10 and 11.

step S1: the microprocessor 35 receives the wiping instruction from the host computer 52 and start the wiping operation.

step S2: the wiping assembly 25 is moved in the direction shown by arrow G1.

step S3: the print head 12 is moved in the direction shown by arrow D1.

step S4: a check is made to determine whether the print head 12 has reached the first position d1. If YES, the program proceeds to step S5; if NO, the program returns to step S3.

step S5: the motor gear 24 is rotated in the direction shown by arrow E1.

step S6: the holder 28 and wiper 27 are moved in the direction shown by arrow F1.

step S7: the wiper motor 23 is stopped.

step S8: the print head 12 is stopped.

step S9: the print head 12 is moved in the direction shown by arrow D2.

step S10: a check is made to determine whether the print head 12 has reached the second point d2. If YES, the program proceeds to step S11; and if NO, the program proceeds to step S9.

step S11: the motor 24 is moved in the direction shown by arrow E2.

step S12: the holder 28 and wiper 27 are moved in the direction shown by arrow F2.

step S13: the wiper 23 is stopped.

step S14: a check is made to determine whether the print head 12 has reached the first position d1. If YES, the program proceeds to step S16; and if NO, the program proceeds to step S15.

step S15: the print head 12 is moved in the direction shown by arrow D2 and the program returns to step S14.

step S16: the wiping assembly 25 is moved in the direction shown by arrow G2.

step S17: the print head 12 is moved in the direction shown by arrow D2.

step S18: the printing operation is resumed.

Figure 12:
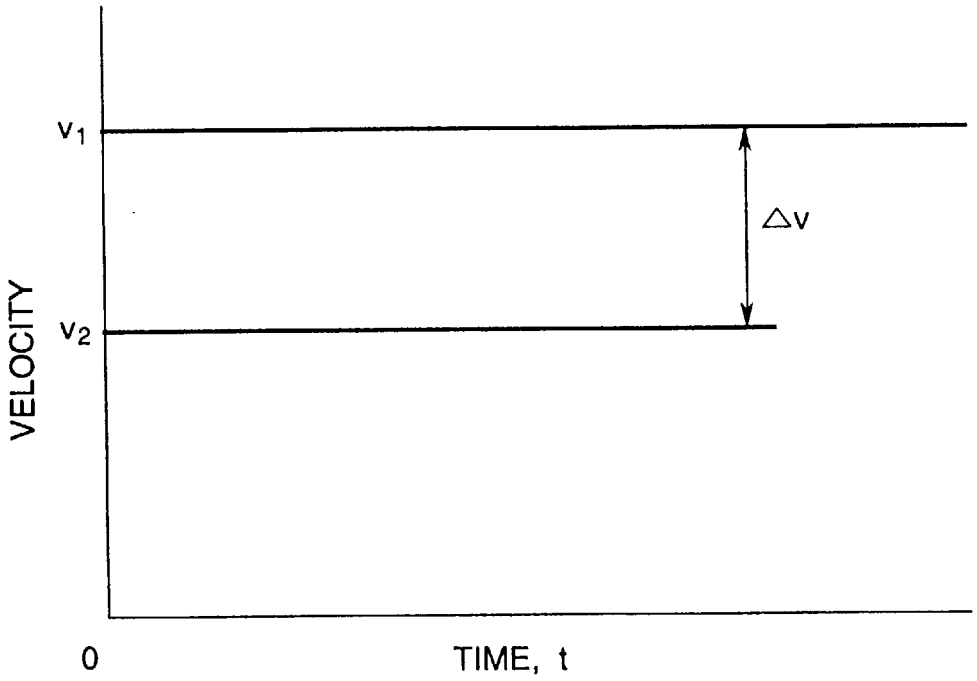
FIG. 12 illustrates velocities at which the wiper 27 and the print head move during wiping operation.

FIG. 12 illustrates velocities at which the wiper 27 and the print head 12 move during wiping operation, the wiper 27 moving at a velocity v2 and the print head 12 moving at a velocity v1 higher than the velocity v2. Therefore, increasing the velocity of the wiper 27 decreases a difference $\Delta V=V1-V2$ in velocity between the print head 12 and wiper 27.

The velocity of the wiper 27 lower than that of the print head 12 is advantageous in that the wiper 27 gently regains its original shape with the aid of its resiliency when the print head 12 gets ahead of the wiper 27 upon completion of the wiping operation. Therefore, the gentle return of the wiper 27 to its original shape is effective in reducing splash of ink when the wiper 27 moves out of rubbing engagement with the print head 12, thereby preventing soiling of the interior of the ink jet printer as well as preventing the wiper 27 from deteriorating after repeated wiping operations.

The difference in velocity $\Delta v$ is determined experimentally and is set to an optimum value according to the shape and material of the wiper 27 so that the wiper 27 is capable of wiping the surface of the nozzle plate 12*a* of the print head 12 without too much splash, and is prevented from deteriorating.

Even if the print head 12 moves in the wiping area at the same velocity as it moves in the printing area, the difference in velocity between the wiper 27 and print head 12 may be maintained at an optimum value if the velocity v2 of the wiper is adjusted appropriately. This is advantageous in that the velocity of the print head 12 need not be greatly decreased for wiping operation.

When the holder 28 and wiper 27 come to a stop shortly after the first stage of the wiping operation, the print head 12 also stops. Then, the print head 12 subsequently starts to move in the direction shown by arrow D2 and the holder 28 and wiper 27 are also moved in the same direction, thus entering the second stage of the wiping operation. The print head 12 is decelerated in the first stage, and is accelerated in the second stage. The values al of acceleration and deceleration can be larger than that a0 of the conventional ink jet printer, reducing the time required for wiping operation.

Figure 13:
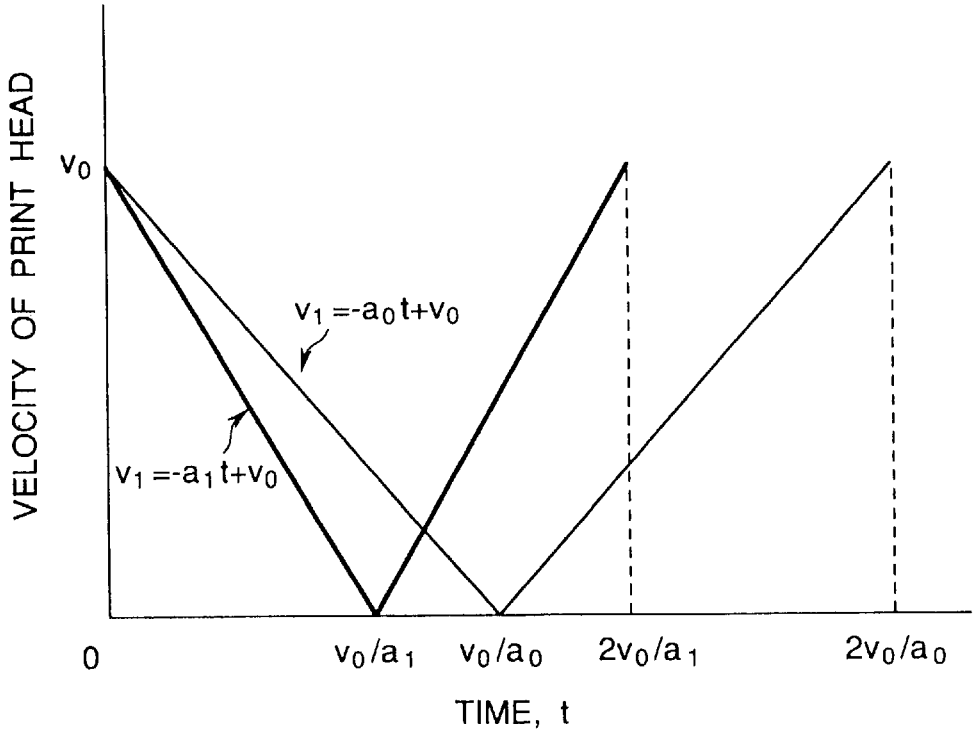
FIG. 13 plots time as the abscissa and changes in the velocity v1 of the print head as the ordinate.

FIG. 13 plots time as the abscissa and changes in the velocity v1 of the print head 12 as the ordinate. In the conventional ink jet printer, as shown in FIG. 13, the velocity v1 of the print head 12 is given by $$v1=-a0\ t+v0$$

where v0 is the velocity of the print head 12 just before the print head is decelerated after the first stage of wiping operation, and a0 is a deceleration. The total time from the beginning of the deceleration of the print head in the first stage till the acceleration is completed in the second stage is 2v0/a0.

In the first embodiment of the present invention, the velocity v1 of the print head 12 is given by $$v1=-a1\ t+v0.$$

The total time from the beginning of the deceleration of the print head 12 in the first stage till acceleration is completed in the second stage is 2v0/a1. Thus, the total time is shortened by the difference 2v0/a0−av0/a1.

Figure 14:
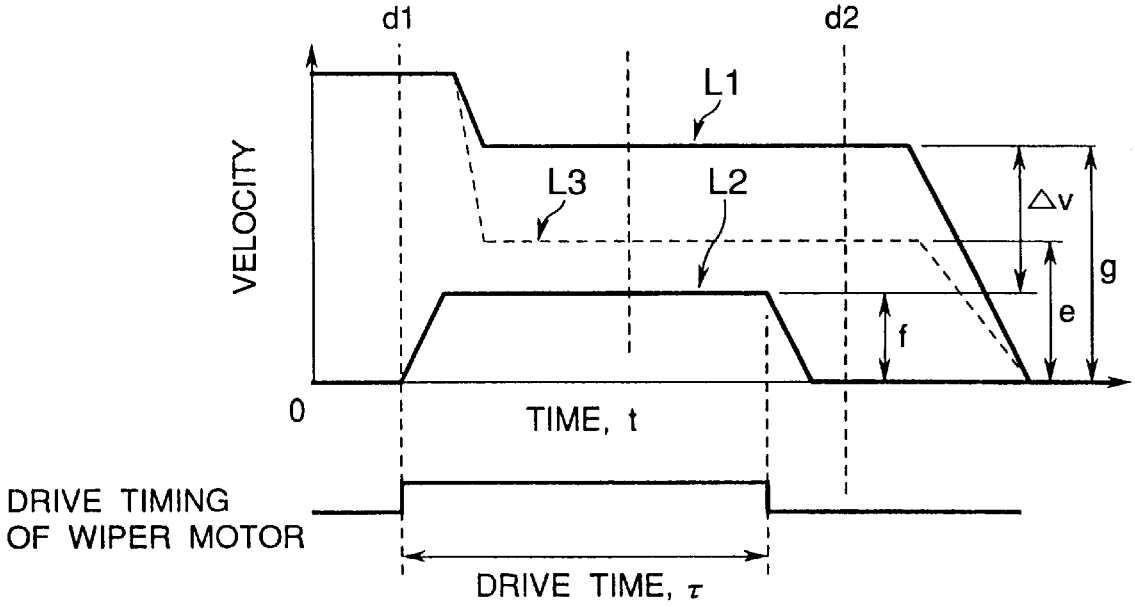
FIGS. 14 and 15 illustrate the relations between the velocities of the print head and wiper.
Figure 15:
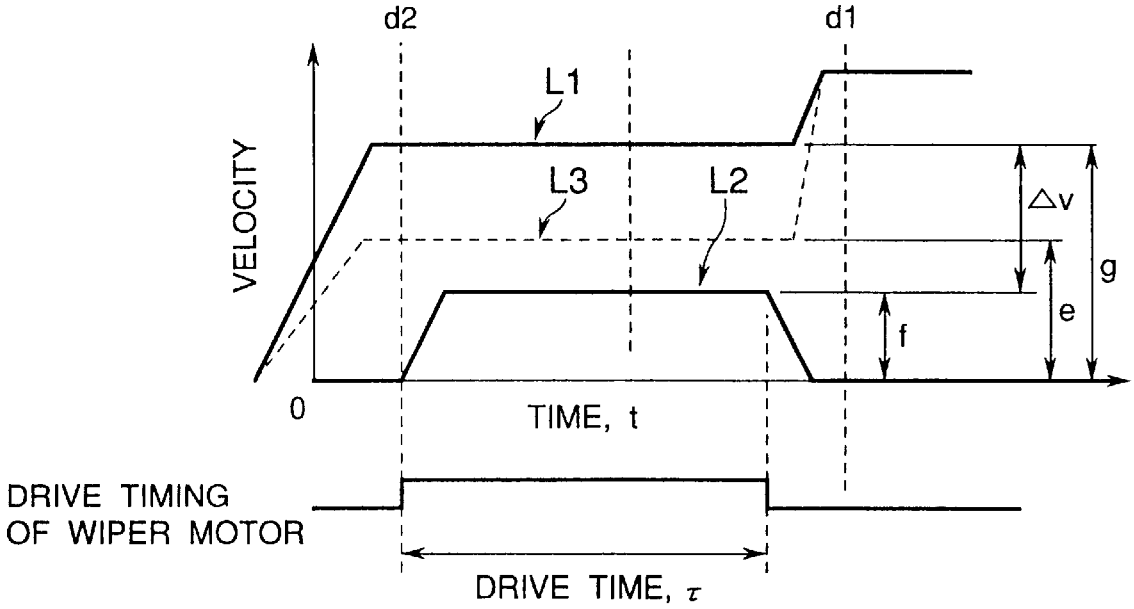

FIGS. 14 and 15 illustrate the relations among the velocity of the print head 12, the velocity of the wiper 27, and the drive timings of the wiper motor 23. Curve L1, Curve L2, and Curve L3 indicate the velocity v1 of the print head 12, the velocity v1 of the wiper 27, and the velocity of the print head of the conventional printer, respectively. The relations among the velocity of the print head 12, the velocity of the wiper 27, and drive timings of the wiper motor 23 will be described with reference to FIG. 14 and 15.

As shown in FIG. 14, the print head 12 of the first embodiment is decelerated after it has passed the first position d1 so that the velocity of the print head 12 is switched from v1 to g. The print head 12 is further decelerated after it has passed the second position d2 and comes to a stop. When the print head 12 reaches the first position d1, the wiper motor 3 (FIG. 3) is started to run so that the wiper 27 is accelerated to a velocity f. The wiper motor 23 runs for a drive time τ so that the motor gear 24 rotates a predetermined number of rotations, and then the wiper motor 23 stops.

In this manner, the relative velocity between the print head 12 and the wiper 27 is Δ v=g−f which is much slower than the velocity of the print head 12. In the conventional ink jet printer, a low velocity of the print head relative to a stationary wiper can only be obtained by decreasing the velocity of the print head to e at the expense of decreased amount of data that can be printed per unit time.

As shown in FIG. 15, when the print head 12 is again moved in the second stage of wiping operation, the print head 12 is accelerated to the velocity g before the second position d2 is reached and further accelerated to the normal velocity just before the first position d1 is reached. The wiper motor 23 is driven into rotation when the print head 12 passes the second position d2, so that the wiper 27 is accelerated to the velocity f. The wiper motor 23 is driven for a time length τ so that the motor gear 24 rotates a predetermined number of rotations.

In this case, too, the difference in velocity between the print head 12 and the wiper 27 is Δ v=g−f which is much slower than the velocity g of the print head 12. In the conventional ink jet printer, a low velocity of the print head relative to a stationary wiper can only be obtained by setting the velocity of the print head to e at the expense of decreased amount of data that can be printed per unit time.

The first embodiment is advantageous in that the velocity of the print head 12 need not be decreased during wiping operation of the print head 12 maintaining the same amount of data that can be printed per unit time.

The ROM 30 stores data items including the first and second positions d1 and d2 of the wiper motor 23, drive time τ, and velocity v2 of the wiper 27. The data may be modified as required to readily adjust or alter the manner in which the wiper 27 operates. Easy modification of these items of data makes the wiping assembly 25 more versatile so that the present invention may also be applied for various other models of ink jet printer.

Second embodiment

Figure 16:
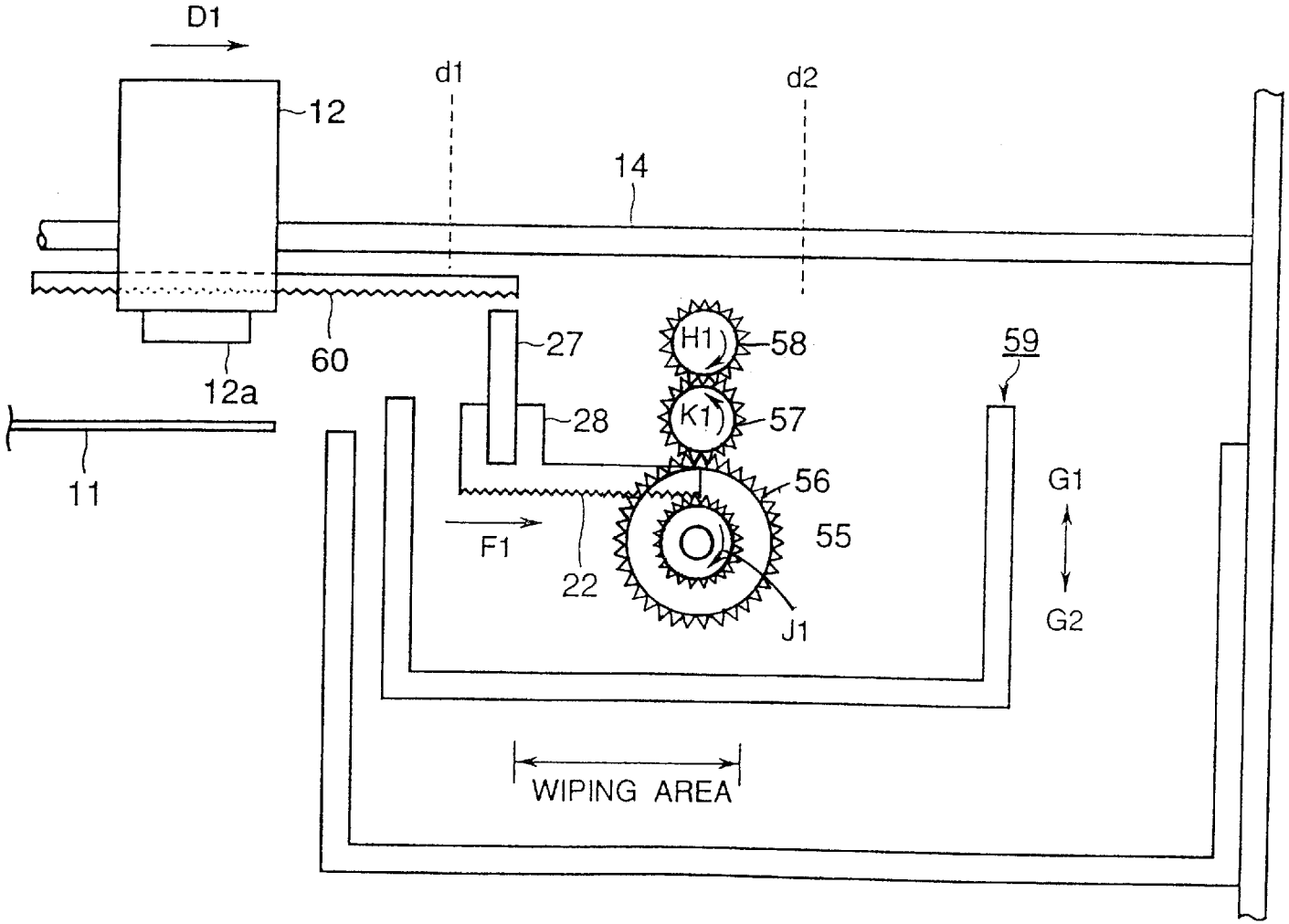
FIG. 16 illustrates a first state of an ink jet printer according to a second embodiment.

FIG. 16 illustrates a first stage of a wiping operation of an ink jet printer according to a second embodiment. Elements similar to those in the first embodiment have been given similar reference numerals.

A wiping assembly 59 includes a holder 28 formed with a rack 22 therein which is in mesh with a gear 55 at all times. The gear 55 has a gear 56 which is concentric with and in one piece construction with the gear 55. The gear 56 has a larger diameter than the gear 55. The gear 56 is in mesh with a gear 57 which in turn is in mesh with a gear 58. The gears 55–58 form a gear train having a predetermined gear ratio.

The rotating shafts of the gears 55–58 are stationary within the wiping assembly 59. A rack 60 is attached to a print head 12 or a carriage, not shown, When the print head 12 enters a wiping area, the rack 60 moves into meshing engagement with gear 58. Thus, when the print head 12 moving in the direction shown by arrow D1 has reached the first position d1, the rack 60 goes into meshing engagement with the gear 58, causing the gear 58 to rotate in a direction shown by arrow H1. As a result, the gear 57 is rotated in a direction shown by arrow K1 and the gears 55 and 56 are rotated in a direction shown by arrow J1. Thus, the wiper 27 moves in a direction shown by arrow F1.

Figure 17:
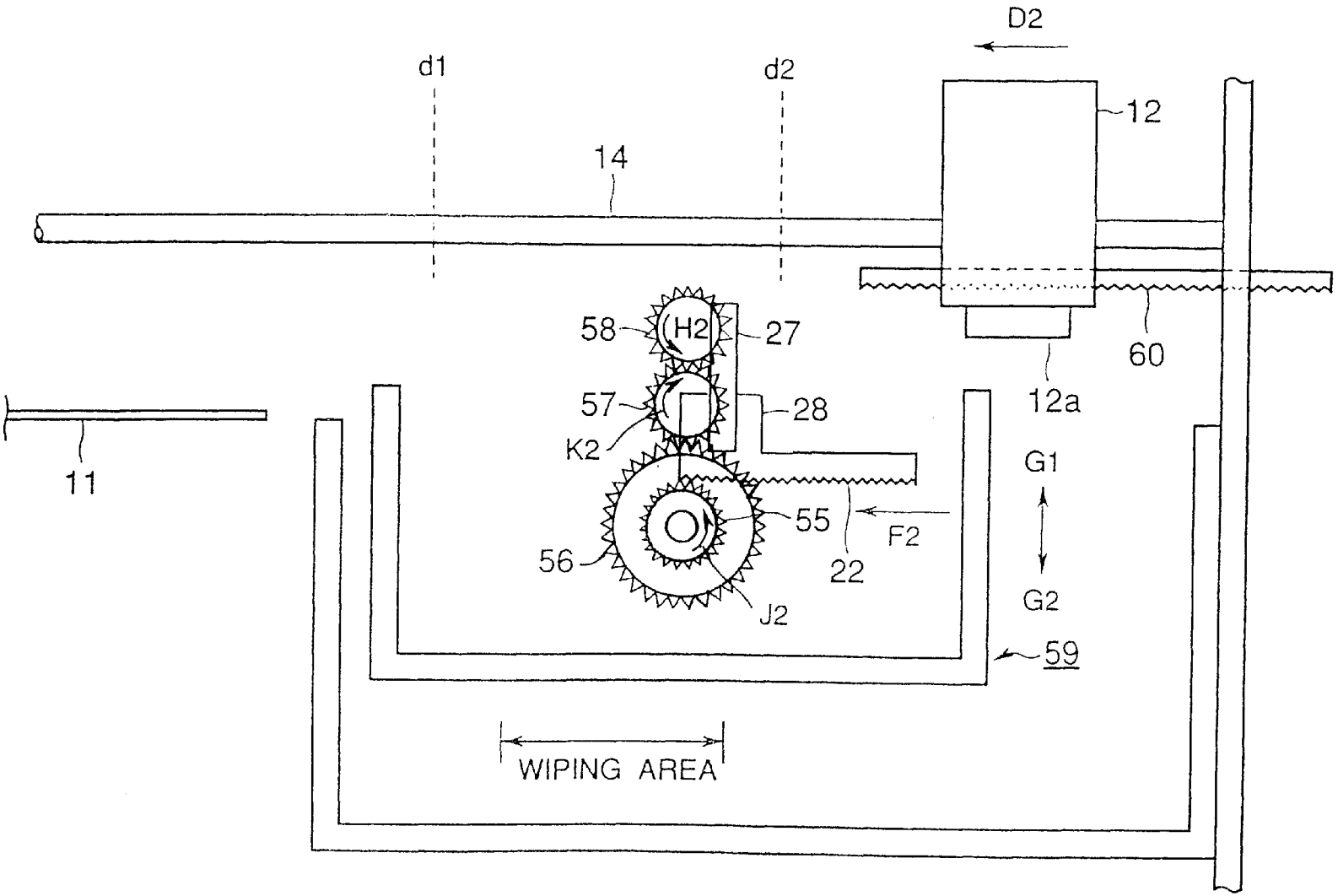
FIG. 17 illustrates a second stage of the ink jet printer of the second embodiment.
Figure 18:
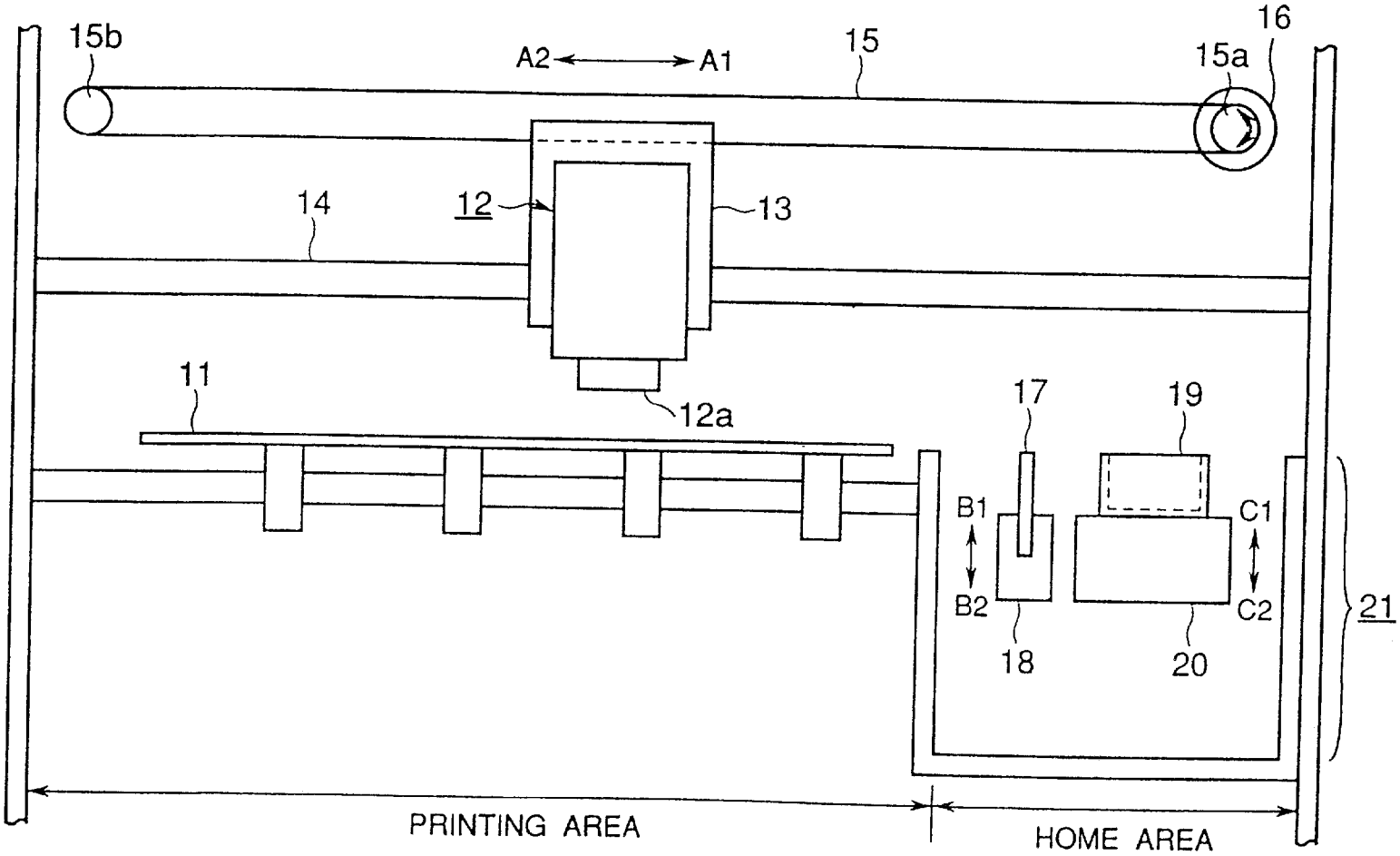
FIG.18 PRIOR ART
FIG. 18 illustrates a general construction of a conventional ink jet printer.
Figure 19:
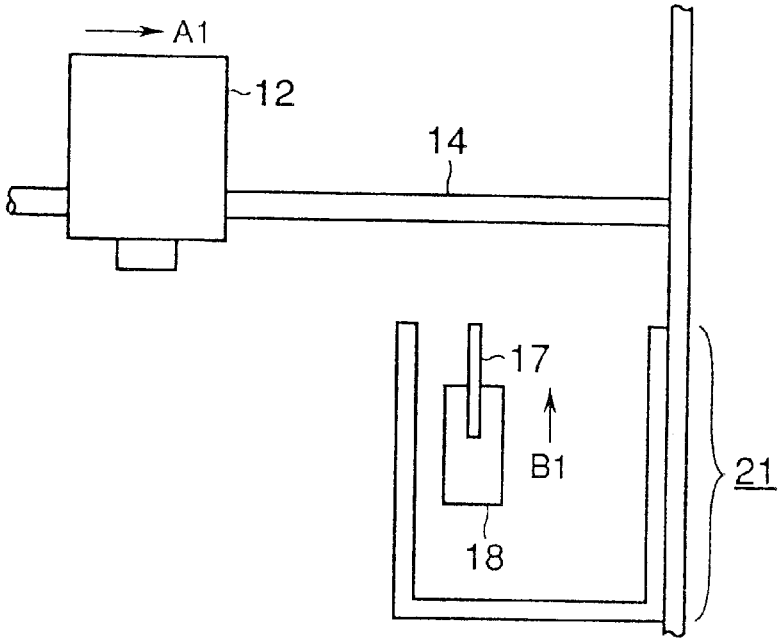
FIG.19 PRIOR ART
FIGS. 19–22 illustrate a relevant portion of the conventional ink jet printer.
Figure 20:
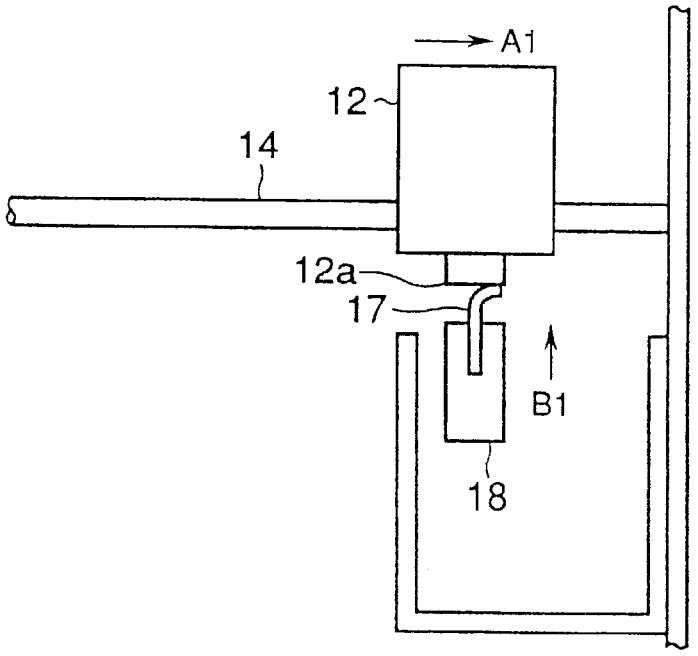
FIG.20 PRIOR ART
Figure 21:
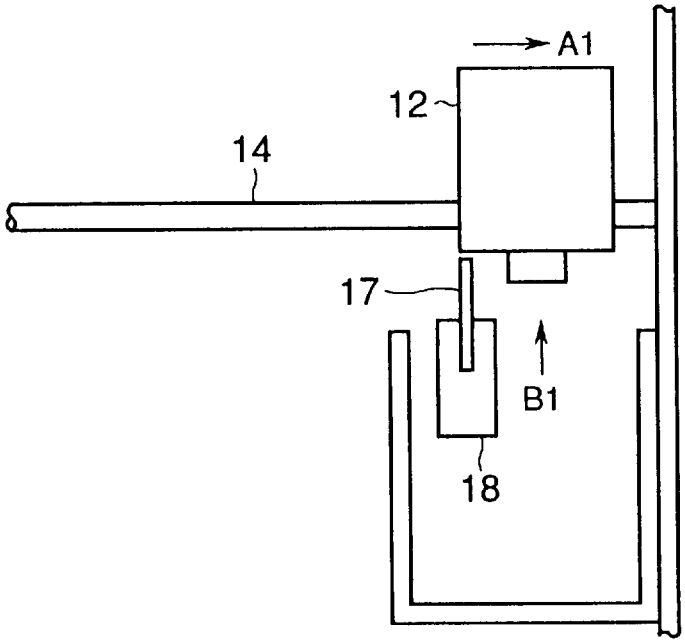
FIG.21 CONVENTIONAL ART
Figure 22:
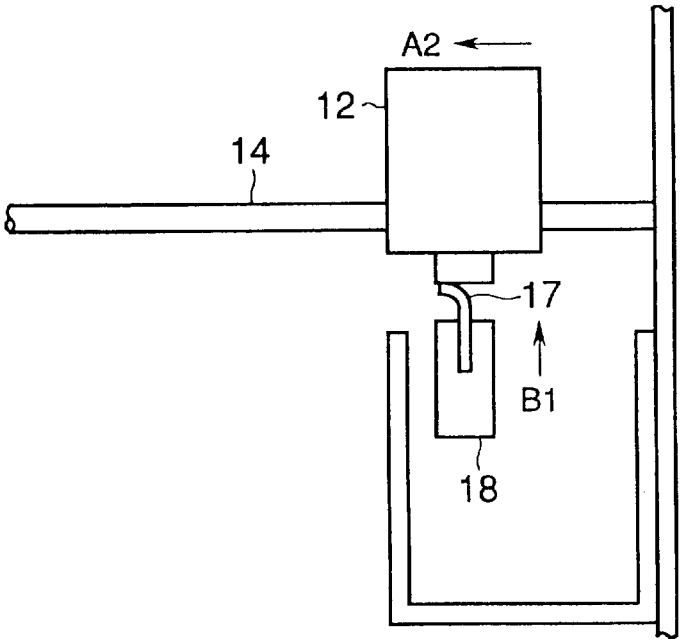
FIG.22 CONVENTIONAL ART

FIG. 17 illustrates a second stage of the ink jet printer of the second embodiment. When the print head 12 moving in a direction shown by arrow D2 has reached the second position d2, the rack 60 moves into meshing engagement with the gear 58 so that the gear 58 is rotated in a direction shown by arrow 112. As a result, the gear 57 is rotated in a direction shown by arrow K2, and the gears 55 and 56 are rotated in a direction shown by arrow J2 so that the wiper 27 is moved in a direction shown by arrow F2.

It is to be noted that the gears 55–58 and rack 60 form a drive power transmitting mechanism.

During the wiping operation, the wiping assembly 59 is moved by an elevator mechanism, not shown, in directions shown by arrows G1 and G2.

In this manner, as the print head 12 passes through the wiping area, the print head 12 gets ahead of the wiper 27 allowing the wiper 27 to wipe the nozzle plate 12*a* of the print head 12. The wiper 27 moves in the same direction as the print head 12, so that the velocity of the wiper 27 relative to the print head 12 is low. The lower relative velocity allows the wiper 27 to more gently regain its original shape when the wiper 27 moves out of engagement with the print head 12 after wiping off the nozzle plate 12*a*. This manner of operation decreases the possibility of the wet ink deposited on the wiper 27 splashing, and suppresses deterioration of the wiper 27.

The print head 12 is allowed to travel back and forth in the wiping area at a velocity reduced only slightly from that at which the printing operation is performed. This shortens the time required for wiping operation, maintaining the amount of data that can be printed per unit time.

The print head 12 moves into engagement with the wiper drive power transmitting mechanism, so that the movement of the print head 12 relative to the drive power transmitting mechanism provides a drive power for the drive mechanism to drive the wiper 27. This mechanism eliminates the need for the wiper motor 23 shown in FIG. 3, simplifying the construction of the ink jet printer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet printer comprising:

A print head moving in a printing area and in a wiping area outside of the printing area;

a wiper disposed in the wiping area, said wiper moving into contact engagement with said print head to wipe the print head when said print head moves in the wiping area; and a wiper-transporting mechanism transporting said wiper relative to said print head so that said wiper wipes said print head as said print head moves in the wiping area, said wiper being transported by said wiper-transporting mechanism at a lower velocity than said print head and in a direction in which said print head moves.

2. The ink jet printer according to claim 1, wherein said wiper transporting mechanism is controlled by a microprocessor which functions as a position detector for detecting a position of said print head when said print head moves in the wiping area, and a wiper supporting mechanism for supporting said wiper and moving in accordance with the position of said print head.

3. The ink jet printer according to claim 2, wherein said wiper supporting mechanism includes a rack-and-pinion mechanism driven by an electric motor so that the rack-and-pinion mechanism drives said wiper to move in the wiping area.

4. The ink jet printer according to claim 1, wherein said wiper transporting mechanism engages said print head to convert a movement of said print head into a driving force that causes said wiper to move parallel with said print head when said print head moves in the wiping area.

5. The ink jet printer according to claim 4, wherein said print head has a rack mounted thereon and said wiper transporting mechanism includes a gear train which moves into meshing engagement with the rack when said print head moves in the wiping area, said gear train converting the movement of said print head into the driving force.

6. The ink jet printer according to claim 5, wherein said wiper transporting mechanism includes a wiper supporting mechanism for supporting and moving said wiper in accordance with the position of said print head.

7. The ink jet printer according to claim 6, wherein said wiper supporting mechanism includes a rack-and-pinion mechanism driven by the gear train so that said wiper is moved in the wiping area.

8. The ink jet printing according to claim 5, wherein the gear train converts the movement of said print head so that the driving force causes said wiper to move at a lower speed than said print head.

* * * * *